United States Patent [19]

Bertsch

[11] Patent Number: 4,543,792

[45] Date of Patent: Oct. 1, 1985

[54] REFRIGERATION SYSTEM WITH CLEARANCE SEALS

[75] Inventor: Peter K. Bertsch, Pepperell, Mass.

[73] Assignee: Helix Technology Corporation, Waltham, Mass.

[21] Appl. No.: 550,008

[22] Filed: Nov. 8, 1983

Related U.S. Application Data

[63] Continuation-in-part of Ser. No. 416,349, Sep. 9, 1982, abandoned.

[51] Int. Cl.[4] ..... F25B 9/00

[52] U.S. Cl. ..... 62/6; 60/520; 92/212; 123/193 P; 277/DIG. 6

[58] Field of Search ..... 62/6; 60/520; 123/193 P; 277/DIG. 6; 92/212

[56] References Cited

U.S. PATENT DOCUMENTS

| | | | |
|---|---|---|---|
| 3,020,056 | 2/1962 | Agens | 277/DIG. 6 |
| 3,364,675 | 1/1968 | Dorer | 62/6 |
| 3,415,054 | 12/1968 | Schulze | 62/6 |
| 3,735,746 | 5/1973 | Schieber | 123/193 P |
| 3,788,088 | 1/1974 | Dehne | 62/6 |
| 3,928,974 | 12/1975 | Benson | 60/650 |
| 3,991,586 | 12/1976 | Acord et al. | 62/6 |
| 4,036,505 | 7/1977 | Floyd et al. | 277/DIG. 6 |
| 4,044,558 | 8/1977 | Benson | 60/520 |
| 4,058,382 | 11/1977 | Mulder | 62/6 |
| 4,060,250 | 11/1977 | Davis et al. | 277/DIG. 6 |
| 4,143,520 | 3/1979 | Zimmerman | 62/6 |
| 4,180,984 | 1/1980 | Chellis | 62/6 |
| 4,189,984 | 12/1980 | Tankred et al. | 92/82 |
| 4,244,192 | 1/1981 | Chellis | 62/6 |
| 4,254,621 | 3/1981 | Nagumo | 123/193 P |
| 4,296,608 | 10/1981 | Lawless | 62/6 |
| 4,403,478 | 9/1983 | Robbins | 62/6 |
| 4,432,313 | 2/1984 | Matlock | 123/193 P |

OTHER PUBLICATIONS

Taylor, C. O., R. M. Dix, W. C. Keith, L. M. Anderson and S. F. Tobias, "The Design and Development of a Miniature Split Stirling Refrigerator", Final Engineering Report by Texas Instruments Inc., Apr. 1976.

"Manufacturing Methods and Technology for the Establishment of Production Techniques for a Split-Cycle Stirling Cryogenic Cooler", 1st Quarterly Report by Martin Marietta for Period of Oct. 1 through Dec. 31, 1977, issued by U.S. Army Electronics Research & Develop Command, Ft. Monmouth, N.J.

Collins, S. C., "A Helium Cryostat", *Rev. of Sc. Instru.*, vol. 18, No. , Mar. 1947, pp. 157–167.

Ferreira, L. E., D. D. Briggs, "Aluminum Oxide and Berryllium Oxide Ceramics—Seal Materials of the Future", Coors Porcelain Co., No. 650303, pp. 153–155.

Kapitza, P., "The Liquefaction of Helium by an Adiabatic Method", Proc. Royal Soc. A147, 189, (1934).

Smirnov, E. N., V. I. Epifanoza, "Calculation of the Coefficient of Delivery for a High-Pressure Cryogen--Liquid Pump with Sealing Clearance", Chem. Petrol. Eng. N., Sep.-Oct. 1969, pp. 680–683.

"Engineering Ceramics", Engineering Materials and Design, Aug. 1977, pp. 19–20.

*Primary Examiner*—Ronald C. Capossela

*Attorney, Agent, or Firm*—Hamilton, Brook, Smith & Reynolds

[57] ABSTRACT

In a split Stirling refrigerator, the dynamic seals about the displacer are virtually dragless clearance seals. The displacer is driven by pressure differential between a working gas and a gas in a spring volume, but the displacer movement is retarded until about peak pressure by forces resulting from fluid friction of gas flowing through the regenerative matrix. The fluid friction results in pressure differentials across the displacer, and the retarding effects of those pressure differentials can be increased to eliminate the need for any Coulomb friction to retard the displacer movement.

11 Claims, 7 Drawing Figures

REFRIGERATION SYSTEM WITH CLEARANCE SEALS

RELATED APPLICATIONS

This is a continuation-in-part application to U.S. patent application Ser. No. 416,349, filed Sept. 9, 1982, now abandoned.

DESCRIPTION

1. Field of the Invention

This invention relates to a refrigeration system in which a reciprocating displacer is driven by a pressure differential across that displacer such as a split Stirling cryogenic refrigerator.

2. Background

A conventional split Stirling refrigeration system is shown in FIGS. 1–4. This system includes a reciprocating compressor 14 and a cold finger 16. The piston 17 of the compressor provides a nearly sinusoidal pressure variation in a pressurized refrigeration gas such as helium. The pressure variation in a head space 18 is transmitted through a supply line 20 to the cold finger 16.

The usual split Stirling system includes an electric motor driven compressor. A modification of that system is the split Vuilleumier. In that system a thermal compressor is used. This invention is applicable to both of those refrigerators as well as others.

Within the housing of the cold finger 16 a cylindrical displacer 26 is free to move in a reciprocating motion to change the volumes of a warm space 22 and a cold space 24 within the cold finger. The displacer 26 contains a regenerative heat exchanger 28 comprised of several hundred fine-mesh metal screen discs stacked to form a cylindrical matrix. Other regenerators, such as those with packed balls, are also known. Helium is free to flow through the regenerator between the warm space 22 and the cold space 24. As will be discussed below, a piston element 30 extends upwardly from the main body of the displacer 26 into a gas spring volume 32 at the warm end of the cold finger.

The refrigeration system of FIGS. 1–4 can be seen as including two isolated volumes of pressurized gas. A working volume of gas comprises the gas in the space 18 at the end of the compressor, the gas in the supply line 20, and the gas in the spaces 22 and 24 and in the regenerator 28 of the cold finger 16. The second volume of gas is the gas spring volume 32 which is sealed from the working volume by a piston seal 34 surrounding the drive piston 30.

Operation of the conventional split Stirling refrigeration system will now be described. At the point in the cycle shown in FIG. 1, the displacer 26 is at the cold end of the cold finger 16 and the compressor is compressing the gas in the working volume. This compressing movement of the compressor piston 17 causes the pressure in the working volume to rise from a minimum pressure to a maximum pressure. The heat of compression is transferred to the environment so the compression is near isothermal. The pressure in the gas spring volume 32 is stabilized at a level between the minimum and maximum pressure levels of the working volume. Thus, at some point the increasing pressure in the working volume creates a sufficient pressure difference across the drive piston 30 to overcome retarding forces, including the friction of displacer seal 36 and drive seal 34. The displacer then moves rapidly upward to the position of FIG. 2. With this movement of the displacer, high-pressure working gas at about ambient temperature is forced through the regenerator 28 into the cold space 24. The regenerator absorbs heat from the flowing pressurized gas and thereby reduces the temperature of the gas.

With the nearly sinusoidal drive from a crank shaft mechanism, the compressor piston 17 now begins to expand the working volume as shown in FIG. 3. With expansion, the high pressure helium in the cold space 24 is cooled even further, but heat transfer from the cooled environment results in a near isothermal expansion. It is this cooling in the cold space 24 which provides the refrigeration for maintaining a temperature difference of over 200 degrees Kelvin over the length of the regenerator.

At some point in the expanding movement of the piston 17, the pressure in the working volume drops sufficiently below that in the gas spring volume 32 for the gas pressure differential across the piston portion 30 to overcome retarding forces such as seal friction. The displacer 26 is then driven downward to the position of FIG. 4, which is also the starting position of FIG. 1. The gas in the cold space 24 is thus driven through the regenerator to extract heat from the regenerator.

It has been understood that the phase relationship between the working volume pressure and the displacer movement is dependent upon the braking force of the seals on the displacer. If those seals provided very low friction, it had been understood that the displacer would move from the lower position of FIG. 1 to the upper position of FIG. 2 as soon as the working volume pressure increased past the pressure in the spring volume 32. Because the spring volume is at a pressure about midway between the minimum and the maximum values of the working volume pressure, movement of the displacer would take place during the mid-stroke of the compressor piston 17. This would result in compression of a substantial amount of gas in the cold end 24 of the cold finger, and because compression of gas warms that gas this would be an undesirable result.

To increase the efficiency of the system, upward movement of the displacer is retarded until the compressor piston 17 is near the end of a stroke as shown in FIGS. 1 and 2. In that way, substantially all of the gas is compressed and thus warmed in the warm end 22 of the cold finger, and that warmed gas is then merely displaced through the regenerator 28 as the displacer moves upward. Thus, the gas then contained in the large volume 24 at the cold end is as cold as possible before expansion for further cooling of that gas. Similarly, it is preferred that as much gas as possible be expanded in the cold end of the cold finger prior to being displaced by the displacer 26 to the warm end. Again, the movement of the displacer must be retarded relative to the pressure changes in the working volume.

In prior systems, the seals 34 and 36 are designed and fabricated to provide an amount of loading to the displacer to retard the displacer movement by an optimum amount. A major problem of split Stirling systems is that with wear of the seals the braking action of those seals varies. As the braking action becomes less the displacer movement is advanced in phase and the efficiency of the refrigerator is decreased. Also, braking action can be dependent on the direction of the pressure differential across the seal.

In addition to the problem of wear of the seals, the refrigerator is often subjected to different environments. For example, a refrigerator may be stored at extremely high temperature and be called on to provide efficient cyogenic refrigeration. On the other hand, the refrigerator may be subject to very cold environments. The sealing action and friction of the seals is generally very dependent on temperature.

A problem common to all helium refrigerators is that, with wear, gaseous and solid particles from worn seals contaminate the helium refrigerant. Those contaminants result in a significant degradation of performance and shorten the operating life of the refrigerator.

DISCLOSURE OF THE INVENTION

A refrigerator has a displacer which reciprocates in a housing to displace gas in a working volume of gas through a regenerator. A spring volume of gas is also in contact with the displacer and is separated from the working volume by a fluid seal surrounding the displacer. All fluid seals between the displacer and the housing are virtually dragless seals. The displacer is driven by pressure differentials between the working volume and the spring volume, but movement of the displacer is retarded by retarding forces due to fluid friction between the working fluid gas and the regenerator. The fluid friction results in differential pressure forces of the working gas acting on the displacer. Where the regenerator is positioned within the displacer, the fluid friction itself also directly acts on the displacer to retard its movement.

The primary characteristics of the displacer and regenerator which must be set to provide the proper retarding forces are the working volume pressure at the warm end of the displacer, the cross-sectional area of the displacer, the spring volume pressure, the cross-sectional area of the displacer in the spring volume and the fluid flow characteristics of the regenerator. The fluid flow characteristics of the regenerator determine the pressure differential between the warm and cold ends of the displacer. The retarding forces cause the displaced movement to begin at about peak maximum or minimum pressure in the working volume at the warm end of the displacer. The displacer reaches full stroke within about 90° of the pressure wave. To that end, $(P_{pw}-P_s)$ is about equal to $\delta(A_c/A_s)$ where $P_{pw}$ is the peak pressure of the working volume of gas at the warm end of the displacer, $P_s$ is the pressure of the spring volume of gas, $\delta$ is the pressure drop across the displacer at $P_{pw}$, $A_c$ is the cross sectional area of the displacer and $A_s$ is the cross sectional area of the drive piston.

In the preferred embodiment, the clearance seal comprises ceramic and preferably a cermet.

BRIEF DESCRIPTION OF THE DRAWINGS

The foregoing and other objects; features and advantages of the invention will be apparent from the following more particular description of a preferred embodiment of the invention, as illustrated by the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT OF THE INVENTION

Figures 1, 2, 3, 4:
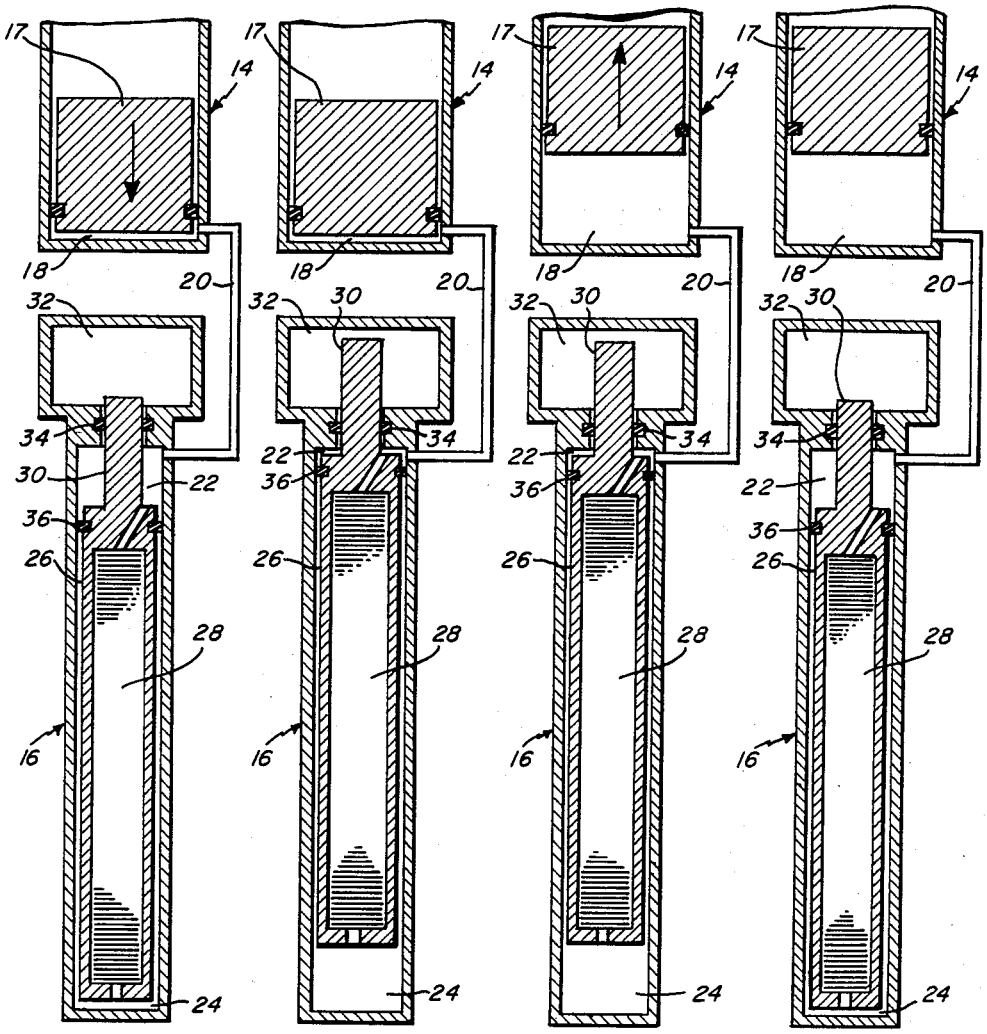
Fig. 1 (PRIOR ART)
Fig. 2 (PRIOR ART)
Fig. 3 (PRIOR ART)
Fig. 4 (PRIOR ART)
FIGS. 1–4 illustrate the operation of a prior art split Stirling refrigerator.
Figure 5:
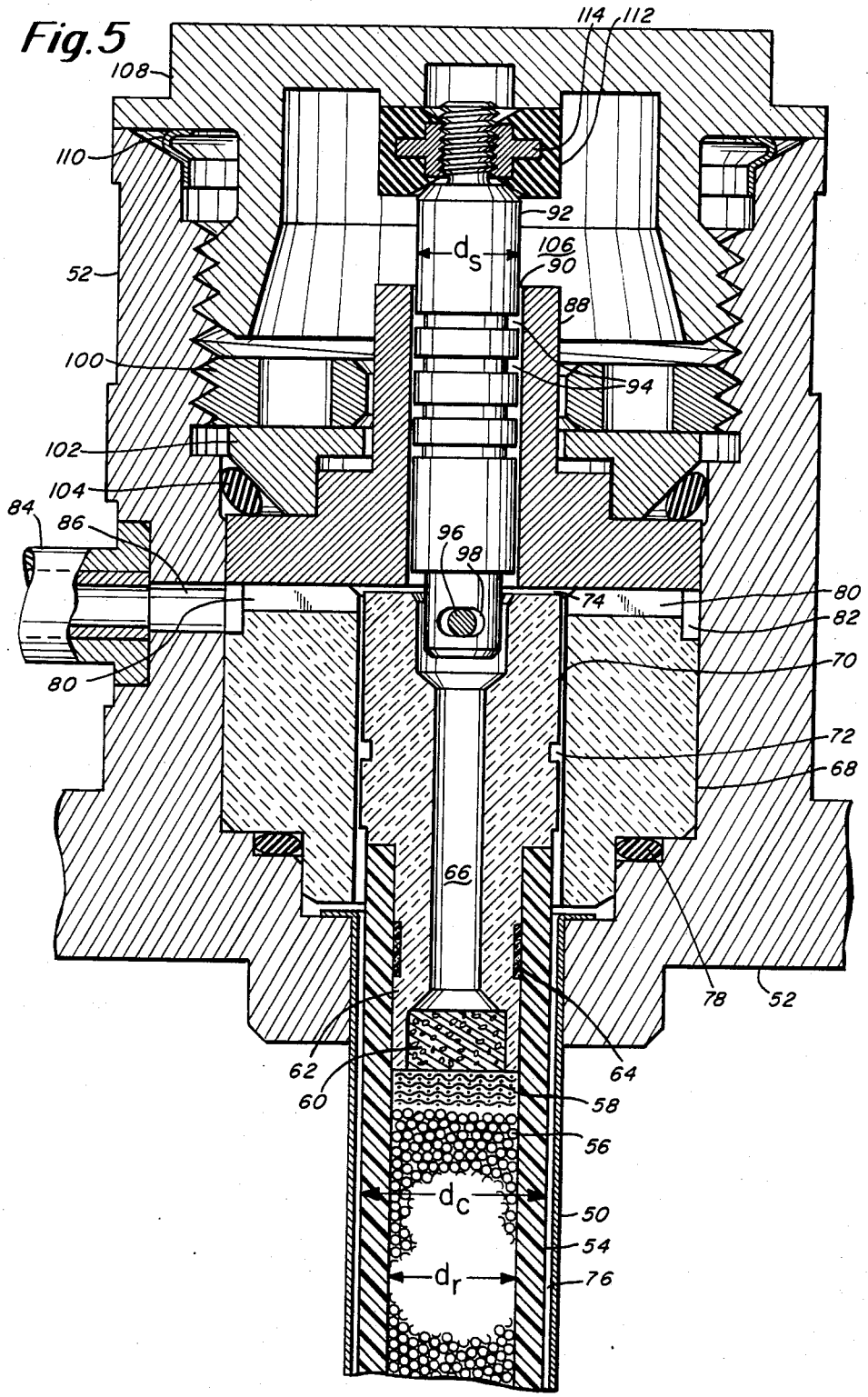
FIG. 5 is an elevational sectional view of a split Stirling refrigerator cold finger embodying the present invention.

The cold finger of a split Stirling refrigerator shown in FIG. 5 includes an outer cylindrical casing 50 fixed to and suspended from a cold finger head 52. The displacer, mounted for reciprocating movement within the cylinder 50, includes a fiberglass epoxy cylinder 54. The cylinder 54 is packed with 0.004 inch (0.1 millimeter) diameter nickel balls 56 sandwiched between short stacks of screen 58 at each end of the regenerator. The screen is held in place by a porous plug 60 positioned at the end of a bore 66 in a cermet clearance seal element 62. The cermet clearance seal element 62 is fixed to the cylinder 54 by epoxy 64.

The cermet element 62 is seated within a second cermet clearance seal element 68 to provide a clearance seal 70. A pressure equalization groove 72 is provided in the first cermet element 62 to minimize pressure force differentials on the clearance seal element which might tend to bind the displacer. The clearance seal 70 is a 0.00015 inch (0.0038 millimeter) gap between the two cermet clearance seal elements. The gap is half the diametrical clearance between the clearance seal elements. That clearance seal allows for virtually dragless movement of the element 62 within the element 68 while providing excellent sealing between the warm end 74 and the annulus 76 between the cold finger cylinder 50 and the displacer cylinder 54. The sealing action of the clearance seal is due to the small gap along the approximately 0.25 inch (six millimeter) length of the seal. To prevent leakage of gas between the outer cermet element 68 and the cold finger head 52, an O-ring 78 provides a static seal.

Use of a cermet clearance seal element riding against a pure ceramic clearance seal element has been found to be particularly advantageous. Any debris which is generated from the ceramic is collected in the softer metal of the cermet. The ceramics in the two clearance seal elements still provide very hard surfaces of greater than 60 on the Rockwell C scale which is desirable for the clearance seal elements. Further, the ceramic in the two clearance seal elements eliminates galling. The cermet has an advantage over the ceramic in that it is more readily machined so the more complex of the two elements should be formed of cermet.

Channels 80 are formed in the top of the clearance seal element 68 to provide fluid communication between the warm end 74 of the cold finger and an annulus 82, also formed in the element 68. The annulus 82 is connected to a compressor (not shown) through a port 86 formed in the cold finger head and a line 84 .

Another outer clearance seal element 88 is positioned over the element 68. This element is formed of hardened stainless steel but might also be formed of cermet or other material comprising ceramic. The clearance seal element 88 has a smaller inner diameter than the element 68 in order to provide a clearance seal 90 with a hardened stainless steel drive piston 92. The piston 92 has four pressure equalization grooves 94.

The piston 92 recriprocates with the main body of the displacer, and in fact the pressure differential across the drive piston serves to drive the entire displacer. In order to ease tolerance requirements in forming the coaxial clearance seals 90 and 70, the piston 92 is joined to the cermet element 62 by means of a pin 96 extending through a transverse slot 98 at the lower end of the piston 92.

The outer clearance seal elements 88 and 68 are clamped down against the cold finger head 52 by means of a clamping nut 100 screw threaded at its outer periphery to ride in complimentary threads in the head 52. The clamping nut 100 bears down against a frustoconical seal retainer 102 which wedges an O-ring static seal 104 against the cold finger head 52 and the outer stainless clearance seal element 88. This seal prevents leakage about the element 88 between the working volume of gas and a spring volume 106.

The spring volume 106 is formed by a cap 108 which is also screw threaded with threads complimentary to those in the head 52. The cap 108 bears down against a metal seal 110. The spring volume is charged to about 450 psig.

A rubber stop 112 is fixed at the upper end of the piston element 92 by a threaded connection between a stop carrier 114 and the piston. The displacer, including piston element, are shown in their uppermost position in FIG. 5 with the stop 112 abutting the cap 108. As the displacer moves to its lowermost position, the stop 112 moves down against the stainless element 88.

In this particular system, the drive piston has an outer diameter $d_s$ of 0.097 inch (2.4 mm). The displacer diameter $d_c$ is about 0.180 inch (4.5 mm). The regenerator matrix diameter $d_r$ is about 0.125 inch (3.2 mm). The displacer stroke distance is about 0.080 inch (0.2 mm).

As noted above, the conventional Stirling cycle refrigerator includes seals about the main body of the displacer and about the drive piston which also serve as friction braking elements. Some means to retard movement of the displacer is required to assure efficient refrigeration. A Stirling cycle refrigerator which makes use of clearance seals rather than friction seals is disclosed in U.S. application Ser. No. 241,418 filed Mar. 6, 1981, in the name of Noel J. Holland. The specific retarding means used in the system disclosed in that application is a discrete, Coulomb friction brake. Coulomb friction is that friction which exists between solid, dry members. The system shown in FIG. 5 eliminates the use of a Coulomb friction brake entirely. In the system shown in FIG. 5, the retarding forces result from fluid friction of the working fluid passing through the regenerator.

Figure 6:
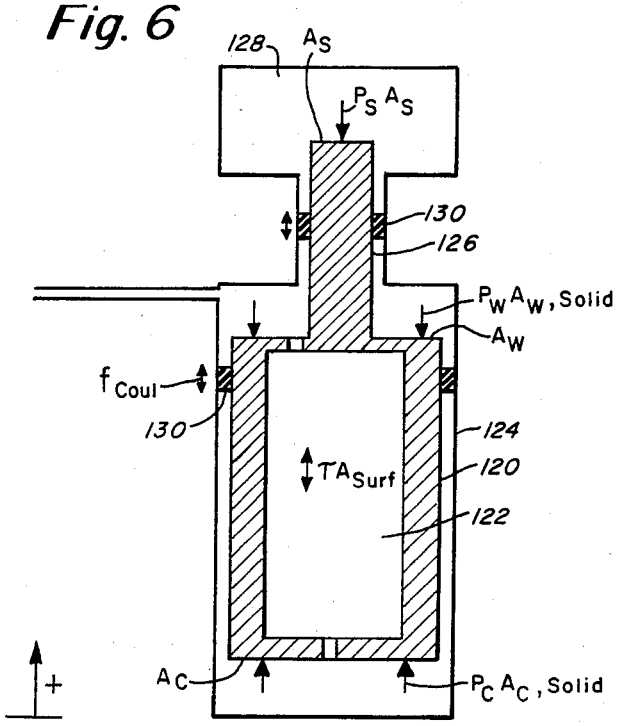
FIG. 6 is a schematic illustration of the cold finger of FIG. 5 along with representations of the pressure and friction forces on the displacer.

The retarding forces of the system shown in FIG. 5 can be best understood with reference to the schematic of FIG. 6. In this schematic, a displacer 120, enclosing a regenerative matrix 122, reciprocates within the cold finger cylinder 124. A drive piston 126 extends upwardly into a spring volume 128. The total area of the bottom of the displacer is $A_C$; the total area at the top of the drive piston 126 is $A_S$; and the area $A_C$ minus the area $A_S$ is $A_W$ at the warm end of the displacer. The forces which act on the displacer at any time can be seen as the pressure $P_W$ acting downward on the displacer, a pressure $P_C$ acting upward on the displacer, and a pressure $P_S$ acting downward on the diplacer. In addition, there are friction forces comprising a Coulomb friction $f_{Coul}$ from any seal or separate friction brake 130 and a fluid friction resulting from the flow of gas through the regenerator. The fluid friction force on the displacer is equal to a shear stress $\tau$ times the effective surface area of the regenerative matrix and internal walls of the displacer 120 seen by the flowing gas.

The downward force on the displacer resulting from the warm volume pressure is equal to that pressure times the effective solid area of the regenerator against which that pressure is applied. Similarly, the force acting upwardly on the displacer due to the cold pressure $P_C$ is equal to that pressure times the effective solid area of the regenerator at the cold end of the displacer.

From the above discussion, the force equation for the displacer can be written as follows:

$$F_{Total}=P_C A_{C,Solid}-P_W A_{W,Solid}-P_S A_S \pm \tau A_{Surf} \pm f_{Coul} \quad (1)$$

Equation 1 can be simplified by recognizing that the fluid friction term $\tau A_{Surf}$ can be written in terms of the pressure differential across the regenerator, $P_C$-$P_w$, and the effective area across the flow passage of the regenerator. Thus, $$\pm \tau A_{Surf}=(P_C-P_W)\, A_{flow} \quad (2)$$

and it follows that:

$$F_{Total}=P_C A_{C,Solid}-P_W A_{W,Solid}-P_S A_S+(P_C-P_W)\, A_{flow} \pm f_{Coul} \quad (3)$$

It can also be recognized that the effective solid area at the warm end of the displacer is equal to the effective solid area at the cold end less the area of the drive piston. Thus, $$A_{W,Solid}=A_{C,Solid}-A_S \quad (4)$$

leads to $$\begin{aligned} F_{Total} = {} & P_C A_{C,Solid} - P_W (A_{C,Solid} - A_S) - P_S A_S + \\ & (P_C - P_W)\, A_{flow} \pm F_{Coul} = \\ & P_C (A_{C,Solid} + A_{flow}) - P_W (A_{C,Solid} - \\ & A_S + A_{flow}) - P_S A_S \pm F_{Coul} \end{aligned} \quad (5)$$

A further simplification of equation 5 can be made by recognizing that the total area at the cold end of the displacer is equal to the effective solid area plus the flow area Thus, $$(A_{C,Solid}+A_{flow})=A_C \quad (6)$$

leads to $$F_{Total}=P_C A_C-P_W (A_C-A_S)-P_S A_S \pm f_{Coul} \quad (7)$$

By defining a term $\delta$ as the pressure drop across the displacer between the warm and cold ends of the displacer the cold pressure term of equation 7 can be replaced as follows:

$$\begin{aligned} P_C &= P_W - \delta \text{ when } P_W \text{ is increasing} \\ P_C &= P_W + \delta \text{ when } P_W \text{ is decreasing} \end{aligned} \quad (8)$$

Further, the total force on the displacer at the instant just prior to movement of the displacer is equal to zero. Setting the total force at zero and substituting for $P_C$ gives $$\begin{aligned} 0 &= (P_W \pm \delta)\, A_C - P_W (A_C - A_S) - P_S A_S \pm f_{Coul} \\ &= P_W (A_S) - P_S A_S \pm \delta A_C \pm f_{Coul} \end{aligned} \quad (9)$$

solving for $P_W$:

$$P_W = P_S \pm \delta(A_C/A_S) \pm (f_{Coul}/A_S) \quad (10)$$

It can be seen from equation 10 that there are two terms relating to the retarding forces on the displacer which act against movement of the displacer. The second term is a function of the Coulomb friction due to seals or a discrete Coulomb friction braking element. The first term is a function of the pressure differential across the regenerative matrix and the areas of the main body of the displacer and of the drive piston. This pressure differential term takes into account both the differential pressure forces acting on the effective solid areas of the displacer and the fluid friction force acting on the displacer.

It should be recognized that even the differential pressures are a direct function of fluid friction in that:

$$\delta = K\ 4f\ (L/D)\ (v^2/2g) \quad (11)$$

where K is a function near unity to account for non-steady state flow, f is the Fanning friction factor (which is in turn a function of the Reynolds number), L is the regenerator length, D is the hydraulic diameter of the regenerator, v is the average velocity of the gas through the regenerator and g is is the acceleration of gravity. It can be recognized, then, that $\delta$ is a function of the fluid flow characteristics of the regenerator and the refrigerator cycle time. Equation (11) also points to a conclusion that a smaller diameter regenerative matrix leads to a larger pressure differential.

The ratio $A_C/A_S$ is always greater than one and can be selected by setting the diameters of the drive piston and main body of the displacer. Thus, to provide increased retarding force to the displacer for proper timing of the displacer relative to the compressor crankshaft angle, the differential pressure term of equation (10) can be increased. In fact, that term can be increased to the extent necessary to account for the entire retarding force needed, and the Coulomb friction term can be decreased to zero. In decreasing the Coulomb friction term to zero, both friction seals and Coulomb friction braking elements can be entirely eliminated.

In a typical, conventional refrigerator, the Coulomb friction term is about 27 PSI. The friction term associated with a clearance seal is less than five PSI and preferably less than one PSI. The total retarding pressure required for proper timing of the displacer, however, is around 160 PSI. Thus, it can be seen that the pressure term need only be increased from about 130 PSI to 160 PSI in a typical refrigerator to provide proper timing without Coulomb friction. The Coulomb friction term is reduced from about 17% of the retarding force to less than 3%, and preferably less than 1%, of that force. Retarding forces resulting from fluid friction of gas flow through the regenerator preferably account for over 99% of the retarding forces.

Figure 7:
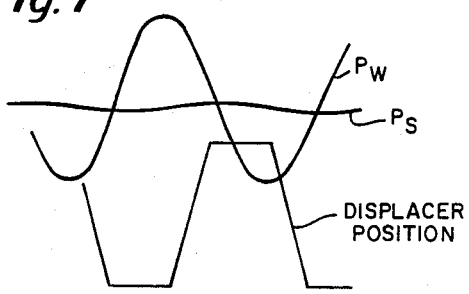
FIG. 7 illustrates the working volume pressure at the warm end of the displacer, the spring volume pressure and the displacer position plotted against time.

FIG. 7 illustrates the proper timing of displacer movement relative to the working volume pressure at the warm end of the displacer; such timing has been obtained with the system described. It can be seen that displacer movement begins at about peak maximum and minimum pressures. Preferably, that movement begins within ±30° of the pressure wave. It is also preferred that the displacer reach the end of a full stroke within about 90° of the pressure wave after peak pressure.

Given the spring volume pressure and an understanding of the warm volume pressure wave and the $\delta$ function, and setting the Coulomb friction term to zero, one can solve, from equation (10), for the ratio $A_C/A_S$ necessary to give the proper timing. Thus, $(P_{pw} - P_s)$ should be about equal to $\delta(A_c/A_s)$ where $P_{pw}$ is the peak pressure. The absolute value of the pressure differential term $(P_{pw} - P_s)$ is about the same for both maximum and minimum peak pressures.

By making use of fluid friction rather than Coulomb friction to account for substantially all of the retarding force, several disadvantages of conventional refrigerators are avoided. For one thing, a too heavy seal force has been found to result in short strokes of the displacer at cryogenic temperatures in certain situations. With a stroke of only about 0.080 inch a small change in seal friction can have significant effects on stroke. A primary advantage of the device shown in FIG. 5 is that full stroking of the displacer is obtained even at cryogenic temperatures.

Another advantage of the present invention is that fluid friction can be made more repeatable from machine to machine, thereby increasing yield. Further, fluid friction is likely to be more stable relative to Coulomb friction over the life of the machine because of the wear of Coulomb friction elements. It is recognized, however, that debris in the gas may result in changes in the fluid friction term of equation (10). However, by using only clearance seals, and not Coulomb friction elements, in the displacer and in the compressor, such debris is minimized. Minimizing the debris in the gas is yet another advantage of the system of FIG. 5.

While the invention has been particularly shown and described with reference to a preferred embodiment thereof, it will be understood by those skilled in the art that various changes in form and details may be made therein without departing from the spirit and scope of the invention as defined by the appended claims. For example an external regenerator might also be used. In that case, the fluid friction $\tau A_{Surf}$ would not act directly on the displacer. However, $A_W$ would equal $A_{W,\ Solid}$, and $A_C$ would equal $A_{C,\ Solid}$. Thus, equation (10) would remain unchanged. Further, the pressure wave may be generated by suitably timed valves.

I claim:

1. In a refrigerator having means for generating a pressure wave in a working volume of gas, a displacer which reciprocates in a housing to displace gas in the working volume of gas through a regenerator and a spring volume of gas of relatively stable pressure in contact with an end surface of a drive piston on the displacer and separated from the working volume of gas by a fluid seal surrounding the drive piston, the displacer being driven solely by pressure differentials between the working volume and the spring volume, there being at least one retarding force applied to the displacer to retard movement of the displacer, the improvement wherein:

all fluid seals between the displacer and housing are virtually dragless seals, the only significant retarding force is that resulting from fluid friction between the regenerator and the gas in the working volume, and the displacer and drive piston are sized relative to system pressures at each end of the displacer and drive piston such that displacer movement begins at about peak maximum and minimum pressures of the working volume at the warm end of the displacer and movement ends at full stroke within about 90° of the working volume pressure wave.

2. A refrigerator as claimed in claim 1 wherein each fluid seal between the displacer and housing is a clearance seal in which a clearance seal element comprises ceramic.

3. A refrigerator as claimed in claim 2 wherein said clearance seal element comprises cermet having a surface hardness of at least 60 on the Rockwell C scale.

4. A refrigerator as claimed in claim 1 wherein the clearance seal comprises a ceramic clearance seal element and a cermet clearance seal element, each clearance element having a surface hardness of at least 60 on the Rockwell C scale.

5. In a refrigerator having means for generating a pressure wave in a working volume of gas, a displacer which reciprocates in a housing to displace gas in the working volume of gas through a regenerator, and a spring volume of gas of relatively stable pressure in contact with an end surface of a drive piston on the displacer and separated from the working volume of gas by a fluid seal surrounding the drive piston, the displacer being driven solely by pressure differentials between the working volume and the spring volume, there being at least one retarding force applied to the displacer to retard movement of the displacer, the improvement that:

all seals between the displacer and drive piston and the housing are clearance seals and a retarding force resulting from fluid friction between the regenerator and the gas in the working volume, including a pressure differential across the displacer, is at least 99% of the retarding force applied to the displacer.

6. A refrigerator as claimed in claim 5 wherein each fluid seal between the displacer and housing is a clearance seal in which a clearance seal element comprises ceramic.

7. A refrigerator as claimed in claim 6 wherein said clearance seal element comprises cermet having a surface hardness of at least 60 on the Rockwell C scale.

8. A refrigerator as claimed in claim 5 wherein the clearance seal comprises a ceramic clearance seal element and a cermet clearance seal element, each clearance element having a surface hardness of at least 60 on the Rockwell C scale.

9. In a refrigerator having a compressor for generating a pressure wave in a working volume of gas, a displacer which reciprocates in a housing to displace gas in the working volume of gas through a regenerator in the displacer, and a spring volume of gas of relatively stable pressure in contact with an end surface of a drive piston on the displacer and separated from the working volume of gas by a fluid seal surrounding the drive piston, the displacer being driven solely by pressure differentials between the working volume and the spring volume, there being at least one retarding force applied to the displacer to retard movement of the displacer, the improvement of:

each fluid seal between the displacer and drive piston and the housing being a virtually dragless clearance seal in which a clearance seal element comprises ceramic and the retarding force to the displacer resulting from fluid friction is the primary retarding force on the displacer, all other retarding forces being virtually zero; and the peak working volume pressure $P_{pw}$ at the warm end of the regenerator, the cross-sectional area $A_C$ of the displacer in the working volume, the spring volume pressure $P_s$, the cross-sectional area $A_s$ of the drive piston and the fluid flow characteristics of the gas through the regenerator resulting in a pressure differential at $P_{pw}$ are such that $(P_{pw}-P_s)$ is about equal to $\delta(A_c/A_s)$ and displacer movement begins at about maximum and minimum peak pressures $P_{pw}$.

10. A refrigerator as claimed in claim 9 wherein said clearance seal element comprises cermet having a surface hardness of at least 60 on the Rockwell C scale.

11. A refrigerator as claimed in claim 9 wherein the clearance seal comprises a ceramic clearance seal element and a cermet clearance seal element, each clearance element having a surface hardness of at least 60 on the Rockwell C scale.

* * * * *